US011377711B2

(12) United States Patent
Zhu et al.

(10) Patent No.: US 11,377,711 B2
(45) Date of Patent: Jul. 5, 2022

(54) 780MPA COLD-ROLLED DUEL-PHASE STRIP STEEL AND METHOD FOR MANUFACTURING THE SAME

(71) Applicant: BAOSHAN IRON & STEEL CO., LTD., Shanghai (IN)

(72) Inventors: Xiaodong Zhu, Shanghai (CN); Xufei Li, Shanghai (CN); Peifang Du, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 559 days.

(21) Appl. No.: 14/761,473

(22) PCT Filed: May 24, 2013

(86) PCT No.: PCT/CN2013/076184
§ 371 (c)(1),
(2) Date: Jul. 16, 2015

(87) PCT Pub. No.: WO2014/114041
PCT Pub. Date: Jul. 31, 2014

(65) Prior Publication Data

US 2015/0361519 A1 Dec. 17, 2015

(30) Foreign Application Priority Data

Jan. 22, 2013 (CN) ..... 201310021998.9

(51) Int. Cl.
*C21D 9/52* (2006.01)
*C22C 38/38* (2006.01)
(Continued)

(52) U.S. Cl.
CPC ..... *C21D 9/52* (2013.01); *C21D 6/002* (2013.01); *C21D 6/005* (2013.01); *C21D 6/008* (2013.01);
(Continued)

(58) Field of Classification Search
CPC ..... C22C 38/02; C22C 38/22; C22C 38/26; C22C 38/28
(Continued)

(56) References Cited

U.S. PATENT DOCUMENTS 4,292,097 A 9/1981 Nakazato et al.
2004/0261919 A1 12/2004 Nakajima et al.
(Continued)

FOREIGN PATENT DOCUMENTS

CN 101153369 A 4/2008
CN 102046827 A 5/2011
(Continued)

OTHER PUBLICATIONS

English language machine translation of CN101153369 to Xiaodong et al. Generated Jun. 7, 2018. (Year: 2018).*
(Continued)

*Primary Examiner* — Brian D Walck
(74) *Attorney, Agent, or Firm* — Quarles & Brady LLP

(57) ABSTRACT

The invention discloses a 780 MPa cold-rolled dual-phase strip steel having a microstructure of fine equiaxed ferrite matrix and martensite islands distributed homogeneously on the ferrite matrix, and comprising the following chemical elements in mass percentage: C: 0.06-0.1%; Si≤0.28%; Mn: 1.8-2.3%; Cr: 0.1-0.4%; Mo: not added when Cr≥0.3%; Mo=0.3—Cr when Cr<0.3%; Al: 0.015-0.05%; at least one of Nb and Ti elements, wherein Nb+Ti is in the range of 0.02-0.05%; and the balance amounts of Fe and other unavoidable impurities. Correspondingly, the invention also discloses a method for manufacturing the 780 MPa cold-rolled dual-phase strip steel. The 780 MPa cold-rolled dual-phase strip steel has high strength, superior elongation, good phosphating property and small anisotropy in mechanical properties.

6 Claims, 1 Drawing Sheet

(51) Int. Cl.

| | |
|---|---|
| ***C21D 8/02*** | (2006.01) |
| ***C21D 8/00*** | (2006.01) |
| ***C21D 6/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |

(52) U.S. Cl.
CPC ..... *C21D 8/005* (2013.01); *C21D 8/0205* (2013.01); *C21D 8/0226* (2013.01); *C21D 8/0236* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01); *C21D 2211/005* (2013.01); *C21D 2211/008* (2013.01)

(58) Field of Classification Search
USPC ..... 148/333
See application file for complete search history.

(56) References Cited

U.S. PATENT DOCUMENTS

| | | | | |
|---|---|---|---|---|
| 2005/0167007 | A1 | 8/2005 | Miura | |
| 2009/0071575 | A1* | 3/2009 | Sun | C22C 38/18 148/537 |
| 2010/0273024 | A1* | 10/2010 | Bocharova | C21D 8/02 428/659 |
| 2012/0138194 | A1* | 6/2012 | Sun | B32B 15/013 148/400 |

FOREIGN PATENT DOCUMENTS

| | | | | |
|---|---|---|---|---|
| CN | 102605240 | A | 7/2012 | |
| CN | 102828119 | A | 12/2012 | |
| CN | 103060703 | A | 4/2013 | |
| EP | 2290111 | A1 | 3/2011 | |
| JP | H05148579 | A | 6/1993 | |
| JP | 2000239791 | A | 9/2000 | |
| JP | 2004052071 | A | 2/2004 | |
| JP | 2005002441 | A | 1/2005 | |
| JP | 2005163115 | A | 6/2005 | |
| JP | 2005264328 | A | 9/2005 | |
| JP | 2005290477 | A | 10/2005 | |
| JP | 2010189712 | A | 9/2010 | |
| JP | 2011246774 | A | 12/2011 | |
| WO | 0109396 | A1 | 2/2001 | |
| WO | WO-2004104254 | A1 * | 12/2004 | H01J 5/03 |

OTHER PUBLICATIONS

English language machine translation of WO-2004104254-A1 to Moulin et al. Generated Sep. 24, 2020. (Year: 2020).*
Viswanathan et al. "Steel Melt Processing." ASM Handbook vol. 15 Casting. pp. 206-229. (Year: 2008).*
PCT International Search Report, PCT/CN2013/076184, dated Oct. 24, 2013, 8 pages.
The State Intellectual Property Office of People's Republic of China, First Office Action, Application No. 201310021998.9, dated Apr. 24, 2014, 11 pages.
The State Intellectual Property Office of People's Republic of China, Second Office Action, Application No. 201310021998.9, dated Jan. 4, 2015, 12 pages.
European Patent Office, Extended European Search Report, Application No. 13872680.7, dated Sep. 23, 2016, 6 pages.
Japan Patent Office, Search Report, Application No. 2015-552973, dated Mar. 10, 2017, 17 pages.
Japan Patent Office, Notification of Reasons for Refusal, Application No. 2015-552973, dated Apr. 26, 2017, 4 pages.
The Ministry of Law and Human Rights Republic of Indonesia, Result of Substantive Examination Stage I, Application No. P200201504056, Jan. 9, 2019, 4 pages.
Canadian Intellectual Property Office, Office Action for application 2,897,885, dated Jul. 16, 2019.
IMPI, Office Action for application MX/a/2015/009431, dated May 9, 2019.
Intellectual Property India, Office Action for application 5937/DELNP/2015, dated Nov. 13, 2019.
Korean Intellectual Property Office, Office Action for application 10-2015-7022817, dated Jul. 12, 2019, 9 pages. With translation.

* cited by examiner

780MPA COLD-ROLLED DUEL-PHASE STRIP STEEL AND METHOD FOR MANUFACTURING THE SAME

CROSS-REFERENCE TO RELATED APPLICATIONS

This application represents the national stage entry of PCT International Application No. PCT/CN2013/076184 filed May 24, 2013, which claims priority of Chinese Patent Application No. 201310021998.9 filed Jan. 22, 2013, the disclosures of which are incorporated by reference here in their entirety for all purposes.

TECHNICAL FIELD

The present invention relates to a dual-phase steel and a method for manufacturing the same, particularly to an iron-based dual-phase steel and a method for manufacturing the same.

BACKGROUND ART

Due to the requirements concerning weight reduction and safety, an increasing amount of steel plate with smaller thickness and higher strength is needed in the automobile industry market. Dual-phase strip steel having a tensile strength of 780 MPa has a good prospect of application because it represents good properties of strength and formability. 780 MPa dual-phase strip steel is expected to be a substitute for 590 MPa cold-rolled dual-phase steel in the future market and become the most widely used dual-phase steel. Dual-phase steel is made by strengthening via phase transformation. In order to guarantee certain hardening capacity, an amount of carbon and alloy elements have to be added into steel to ensure that supercooled austenite would be converted into martensite during the cooling of the dual-phase steel. However, high contents of carbon and alloy elements are unfavorable for the weldability of steel plate. Moreover, alloy elements tend to segregate in the course of casting, resulting in banded structure in cold-rolled strip steel. Consequently, cold-rolled dual-phase steel differentiates significantly in different directions, leading to a series of problems in practical use.

Carbon equivalent of steel mainly depends on carbon content, alloy element content and impurity element content in the steel. Carbon equivalent may be characterized using a variety of formulae, and is usually represented by Pcm value for automobile steel: Pcm=C+Si/30+Mn/20+2P+4S. Generally, Pcm value may be used to characterize the embrittlement tendency of steel plate after welding and cooling. When Pcm is higher than 0.24, welding spot tends to crack at the interface. It is safe when Pcm is lower than 0.24.

Steel is an anisotropic material in nature. As a continuous process is used for the production of strip steel, an orientational distribution exists in the steel structure to varying extent. In other words, an elongated band-like distribution is exhibited along the rolling direction. Due to high alloy element content in high-strength steel, composition segregation occurs easily. Furthermore, it is difficult to eliminate the segregation of substitutional alloy elements. The structure of steel is deformed and elongated during hot rolling and cold rolling, and finally forms a banded structure. Generally, the banded structure contains high contents of alloy elements and carbon, such that hard and brittle martensite having a band-like distribution is formed in the dual-phase steel after quenching, which is considerably detrimental to the properties of the steel. Therefore, alleviation of the banded structure to obtain a homogeneously distributed structure is the key to acquire good properties for high-strength dual-phase strip steel.

A Chinese patent literature that has a publication number of CN102212745A and was published on Oct. 12, 2011 and titled "High-plasticity 780 MPa Cold-rolled Dual-phase Steel and Manufacturing Method Thereof" discloses a method for manufacturing a high-plasticity 780 MPa cold-rolled dual-phase steel which has the following chemical composition: 0.06-0.08% C, 1.0-1.3% Si, 2.1-2.3% Mn, 0.02-0.07% Al, S≤0.01%, N≤0.005%, P≤0.01%, and the balance amounts of Fe and other unavoidable impurities. The end rolling temperature for hot rolling is 890° C., the coiling temperature is 670° C., the cold rolling reduction amount is 50-70%, and a conventional gas jet cooling continuous annealing is used.

An American patent literature that has a publication number of US20040238082A1 and was published on Dec. 2, 2004 and titled "High-strength Cold-rolled Steel Plate and Method for Production Thereof" discloses a method for manufacturing high-strength steel having good hole-expanding property, wherein the steel has the following chemical composition: 0.04-0.1% C, 0.5-1.5% Si, 1.8-3% Mn, P≤0.020%, S≤0.01%, 0.01~0.1% Al, N≤0.005%, and the balance amounts of Fe and other unavoidable impurities. The steel plate is hot rolled between Ar3-870° C., coiled at a temperature below 620° C., and annealed at 750-870° C. Rapid cooling begins at 550-750° C. at a rapid cooling speed≥100° C./s, and ends at a temperature below 300° C. Finally, cold-rolled high-strength steel having a tensile strength of higher than 780 MPa and a hole-expanding ratio of at least 60% is obtained. Relatively high contents of Mn and Si are employed in the composition design of this steel plate.

A Japanese patent literature that has a publication number of JP Publication 2007-138262 and was published on Jun. 7, 2007 and titled "High-strength Cold-rolled Steel Plate With Small Variation Of Mechanical Properties And Manufacturing Method Thereof" relates to a high-strength cold-rolled steel plate which has the following chemical composition: 0.06-0.15% C, 0.5-1.5% Si, 1.5-3.0% Mn, 0.5-1.5% Al, S≤0.01%, P≤0.05%, and the balance amounts of Fe and other unavoidable impurities. The manufacturing process comprises the following steps: holding at Ac1~Ac3 for 10 s, cooling to 500-750° C. at a cooling speed of 20° C./s, and cooling to a temperature below 100° C. at a cooling speed of higher than 100° C./s. 780 MPa high-strength steel plate having a hole-expanding ratio≥60 may be obtained.

None of the above literatures describe control over the banded structure in the steel, nor do they propose relevant solutions to the improvement of the anisotropy. Thus, the above patents do not relate to improvement of anisotropic mechanical properties of dual-phase steel.

SUMMARY

The object of the invention is to provide a 780 MPa cold-rolled dual-phase strip steel and a method for manufacturing the same, wherein a dual-phase strip steel having a homogeneous microstructure, good phosphating property and small anisotropy of mechanical properties is expected to be obtained by a design featuring low carbon equivalent, so that the cold-rolled dual-phase strip steel may meet the bi-directional demands of automobile industry on smaller thickness and higher strength of steel.

In order to achieve the above object of the invention, the invention provides a 780 MPa cold-rolled dual-phase strip steel, wherein the strip steel has a microstructure of fine equiaxed ferrite matrix and martensite islands distributed homogeneously on the ferrite matrix, and comprises the following the chemical elements in mass percentages:

C 0.06-0.1%;

Si≤0.28%;

Mn 1.8-2.3%;

Cr 0.1-0.4%;

Mo not added when Cr≥0.3%; Mo=0.3%—Cr when Cr≤0.3%;

Al 0.015-0.05%;

at least one of Nb and Ti elements, wherein Nb+Ti is in the range of 0.02-0.05%;

the balance amounts of Fe and other unavoidable impurities.

The principle for designing the various chemical elements in the 780 MPa cold-rolled dual-phase strip steel of the invention is as follows:

C: C may increase the strength of martensite and influence the content of martensite. It has much influence on the strength, but increased carbon content is not good to weldability of strip steel. The strength will be insufficient if carbon content is less than 0.06%, whereas the weldability will be decreased if carbon content is higher than 0.1%. Therefore, carbon content of 0.06-0.1 wt % is selected in the technical solution of the invention.

Si: Si acts to strengthen solid solution in dual-phase steel. Si can enhance the activity of carbon element, facilitate segregation of C in the Mn rich zone, and increase the carbon content in the band-like zone. However, Si is undesirable for the phosphating property of strip steel. Hence, an upper limit for Si content has to be set. The technical solution of the invention requires Si≤0.28 wt %.

Mn: Mn may increase the hardenability of steel and enhance the strength of steel effectively. But Mn will deteriorate the weldability of strip steel. Mn segregates in steel, and tends to be rolled into Mn rich zone having band-like distribution in the course of hot rolling, so as to form a banded structure which is undesirable for the structure homogeneity of dual-phase steel. When Mn is less than 1.8%, the hardenability and strength of strip steel will be insufficient. When Mn is more than 2.3%, the banded structure in strip steel will be exasperated and the carbon equivalent will be increased. Therefore, the content of Mn is set to be 1.8-2.3 wt %.

Cr: Cr may increase the hardenability of strip steel. Meanwhile, addition of Cr may make up the function of Mn. When Cr is less than 0.1%, the effect is not obvious. But when Cr is more than 0.4%, unduly high strength and decreased plasticity will be resulted. Thus, the Cr content in the technical solution of the invention is controlled to be 0.1-0.4 wt %.

Mo: Mo may increase the hardenability of steel and enhance the strength of strip steel effectively. Furthermore, Mo can ameliorate the distribution of carbides. Both Mo and Cr can assist in the hardenability of strip steel. Therefore, in the present technical solution, the addition of Mo is related to Cr. When the Cr content is lower than 0.3 wt %, the addition amount of shall be (0.3—Cr). When the Cr content is higher than 0.3 wt %, no addition of Mo is needed.

Al: Al has the function of deoxygenation and grain refinement in steel. The technical solution of the invention requires Al in the range of 0.015-0.05 wt %.

Nb, Ti: Nb and Ti are strengthening elements for precipitation, and have the function of grain refinement. They may be added separately or in combination, but the total amount to be added shall be controlled to be 0.02-0.05 wt %.

Furthermore, the following chemical elements are defined for the 780 MPa cold-rolled dual-phase strip steel of the invention: C 0.07-0.09 wt %; Mn 1.9-2.2 wt %; Al 0.02-0.04 wt %.

In the aspect of composition design, relatively low carbon content, relatively low total addition amount of alloy elements, and a manner of adding a multiplicity of alloy elements in combination are employed for the 780 MPa cold-rolled dual-phase strip steel of the invention. For the present technical solution, the selection of relatively low carbon content may decrease the enrichment degree of C in steel and hamper the tendency of forming a banded structure. The selection of decreased content of the main alloy element Mn in dual-phase steel may effectively reduce the probability of the occurrence of a banded structure in strip steel and abate the undesirable impact on the phosphating property. Strict restriction on the addition of Si may reduce C atom segregation resulting from the change of C atom activity caused by Si. Addition of a certain amount of Cr, Mo and other alloy elements may compensate the decreased hardenability resulting from relatively low content of Mn. Such a composition design may efficiently control the carbon equivalent Pcm in steel to be lower than 0.24. As such, not only welding cruciform tensile fastener-like crack can be obtained, but also no less than 780 MPa of steel strength can be guaranteed. As the microstructure of the strip steel comprises fine equiaxed ferrite matrix and martensite islands distributed homogeneously on the ferrite matrix, the banded structure exhibited therein is minute. Therefore, the strip steel shows small anisotropy in its mechanical properties and has good cold bending property and hole expanding property.

Correspondingly, the invention also provides a method for manufacturing the 780 MPa cold-rolled dual-phase strip steel, comprising the following steps:

1) Smelting;
2) Casting: A secondary water-cooling process is used wherein the water jet capacity is not less than 0.7 L water/kg steel blank;
3) Hot rolling: The end rolling temperature is controlled to be 820-900° C., followed by rapid cooling after rolling;
4) Coiling: The coiling temperature is controlled to be 450-650° C.;
5) Cold rolling;
6) Continuous annealing: holding at 800-860° C., cooling to 640-700° C. at a cooling speed of not less than 5° C./s, further cooling to 220-280° C. at a cooling speed of 40-100° C./s, and tempering at 220-280° C. for 100-300 s.

Further, the above method for manufacturing the 780 MPa cold-rolled dual-phase strip steel also comprises step 7): temper rolling.

Further, the cold rolling reduction rate is 40-60% in the above step 5).

Still further, the temper rolling elongation is 0.1-0.4% in the above step 7).

In the aspect of manufacturing process, the use of a secondary water-cooling process in the continuous casting step to cool the steel blank rapidly and evenly with a large cooling water jet capacity at a rapid cooling speed may refine the structure of the continuously cast blank. As such, fine carbides are dispersively distributed on the ferrite matrix in the form of particles. Relatively low end rolling temperature is used in the hot rolling step, and relatively low coiling temperature is used in the coiling step similarly. This may refine grains, and decrease the distribution continuity of the banded structure. Relatively high annealing and holding temperatures are used in the continuous annealing step, which may restrain the formation of the banded structure in the steel. Rapid cooling after homogeneous heating is also favorable for lessening segregation of carbon and inhibiting formation of the banded structure. After the above process steps, the microstructure of the 780 MPa cold-rolled dual-phase strip steel described herein exhibits fine equiaxed ferrite matrix and martensite islands distributed homogeneously on the ferrite matrix. The mechanical properties thereof show small anisotropy, and the structure is homogeneous.

Compared with the prior art, the 780 MPa cold-rolled dual-phase strip steel described herein shows homogeneous distribution of martensite, a minute banded structure, a fine and dense phosphating film on the surface, good weldability, superior homogeneity of mechanical properties, excellent phosphating property, and small difference between the longitudinal and lateral properties. It is desirable for stamping of dual-phase steel, can satisfy the requirements of high-strength dual-phase steel in terms of strength and formability, and can be used widely in automobile manufacture and other fields.

According to the method for manufacturing the 780 MPa cold-rolled dual-phase strip steel described herein, high-strength cold-rolled dual-phase strip steel having a homogeneous microstructure, good cold bending and hole expanding properties, and small anisotropy in mechanical properties is obtained by a suitable composition design and modified manufacturing steps without adding any difficulty to the procedures.

DETAILED DESCRIPTION

Figure 1:
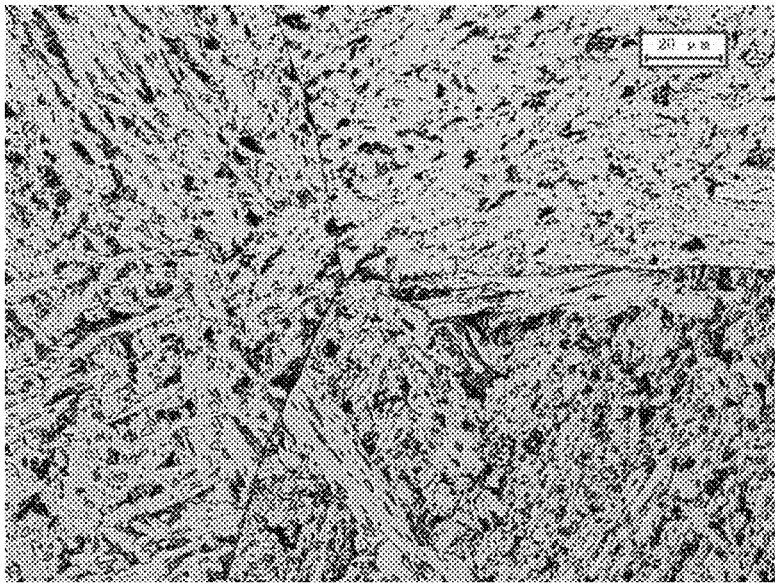
FIG. 1 shows the as-cast microstructure of the 780 MPa cold-rolled dual-phase strip steel according to Example 3.

The technical solution of the invention will be further demonstrated with reference to the following specific examples and accompanying drawings.

The 780 MPa cold-rolled dual-phase strip steel described herein was made according to the following steps:

1) Smelting: the proportions of the chemical elements were controlled as shown in Table 1;
2) Casting: A secondary water-cooling process was used wherein the water jet capacity was not less than 0.7 L water/kg steel blank;
3) Hot rolling: The end rolling temperature was controlled to be 820-900° C., followed by rapid cooling after rolling;
4) Coiling: The coiling temperature was controlled to be 450-650° C.;
5) Cold rolling: The cold rolling reduction rate was 40-60%;
6) Continuous annealing: holding at 800-860° C., cooling to 640-700° C. at a cooling speed of not less than 5° C./s, further cooling to 220-280° C. at a cooling speed of 40-100° C./s, and tempering at 220-280° C. for 100-300 s;
7) temper rolling: The temper rolling elongation was 0.1-0.4% (this step was not performed in Example 1).

TABLE 1

| | Chemical elements (wt %) | | | | | | | |
|---|---|---|---|---|---|---|---|---|
| No. | C | Si | Mn | Cr | Mo | Al | Nb | Ti |
| Ex. 1 | 0.06 | 0.2 | 2.3 | 0.4 | 0 | 0.015 | 0.02 | 0.03 |
| Ex. 2 | 0.07 | 0.28 | 1.8 | 0.3 | 0 | 0.05 | 0.03 | 0.01 |
| Ex. 3 | 0.08 | 0.25 | 1.9 | 0.25 | 0.05 | 0.02 | 0.025 | 0.025 |
| Ex. 4 | 0.09 | 0.1 | 2.1 | 0.2 | 0.1 | 0.03 | 0.02 | 0.02 |
| Ex. 5 | 0.1 | 0.03 | 2.0 | 0.1 | 0.2 | 0.04 | 0.015 | 0.015 |
| Ex. 6 | 0.085 | 0.15 | 2.2 | 0.22 | 0.08 | 0.035 | 0.01 | 0.01 |

Table 2 shows the specific process parameters of the examples. Examples 2-1 and 2-2 indicate that they both used the component proportions of Example 2 shown in Table 1, and Examples 5-1 and 5-2 indicate that they both used the component proportions of Example 5 shown in Table 1.

TABLE 2

| | | | | Continuous annealing | | | | | | | |
|---|---|---|---|---|---|---|---|---|---|---|---|
| | Casting | Hot rolling | | | | | | | | | |
| No. | Secondary cooling water capacity (L/kg) | End rolling temperature (° C.) | Coiling temperature (° C.) | Holding temperature (° C.) | Slow cooling speed (° C./s) | Inlet temperature for rapid cooling (° C.) | Outlet temperature for rapid cooling (° C.) | Rapid cooling speed (° C./s) | Temper temperature (° C.) | Temper time (s) | Temper rolling elongation (%) |
| Ex. 1 | 0.8 | 830 | 450 | 805 | 11 | 690 | 250 | 100 | 250 | 250 | / |
| Ex. 2-1 | 0.85 | 850 | 500 | 800 | 10 | 700 | 280 | 80 | 270 | 150 | 0.2 |
| Ex. 2-2 | 0.9 | 860 | 550 | 820 | 9 | 670 | 260 | 60 | 260 | 200 | 0.3 |
| Ex. 3 | 0.95 | 890 | 600 | 840 | 6 | 680 | 240 | 50 | 240 | 100 | 0.4 |
| Ex. 4 | 1 | 840 | 650 | 860 | 7 | 660 | 230 | 40 | 230 | 300 | 0.3 |
| Ex. 5-1 | 0.82 | 880 | 610 | 850 | 5 | 640 | 220 | 45 | 220 | 250 | 0.2 |
| Ex. 5-2 | 0.87 | 870 | 520 | 800 | 10 | 645 | 280 | 50 | 280 | 180 | 0.3 |
| Ex. 6 | 0.93 | 900 | 570 | 835 | 8 | 650 | 270 | 70 | 240 | 120 | 0.1 |

Table 3 shows the properties of the cold-rolled dual-phase steel of the examples according to the present technical solution.

TABLE 3

| | Lateral sampling tensile properties | | | Longitudinal sampling tensile properties | | | Lateral bending | Longitudinal bending | Hole expanding |
|---|---|---|---|---|---|---|---|---|---|
| No. | σs (Mpa) | σb (Mpa) | δ (%) | σs (Mpa) | σb (Mpa) | δ (%) | (180° cold bending) | (180° cold bending) | ratio (%) |
| Ex. 1 | 415 | 790 | 22 | 420 | 785 | 23 | 1a | 2a | 35 |
| Ex. 2-1 | 420 | 810 | 22 | 415 | 815 | 22 | 1a | 2a | 34 |
| Ex. 2-2 | 435 | 820 | 20 | 430 | 810 | 20 | 1a | 2a | 40 |
| Ex. 3 | 450 | 840 | 19 | 430 | 845 | 20 | 1a | 2a | 50 |
| Ex. 4 | 460 | 840 | 19 | 450 | 830 | 19 | 1a | 2a | 45 |
| Ex. 5-1 | 470 | 860 | 18 | 450 | 855 | 19 | 1a | 2a | 55 |
| Ex. 5-2 | 455 | 830 | 21 | 440 | 810 | 20 | 1a | 2a | 36 |
| Ex. 6 | 485 | 855 | 19 | 470 | 845 | 19 | 1a | 2a | 51 |

As shown in Table 3, the 780 MPa cold-rolled dual-phase strip steel described herein has high strength, good elongation, small anisotropy in mechanical properties, and can replace the 590 MPa cold-rolled dual-phase steel for use in the field of automobile manufacture.

Figure 2:
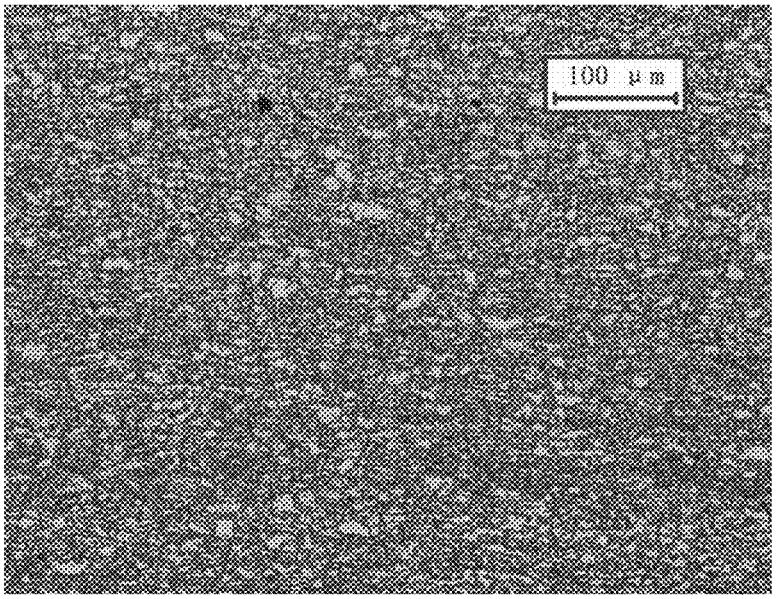
FIG. 2 shows the microstructure of the 780 MPa cold-rolled dual-phase strip steel according to Example 3.

FIG. 1 shows the as-cast microstructure of Example 3, and FIG. 2 shows the microstructure of this example. As shown in FIG. 1, the as-cast structure of the cold-rolled dual-phase steel comprises cementite distributed dispersively on the ferrite grains. As shown in FIG. 2, the microstructure of the cold-rolled dual-phase steel comprises fine equiaxed ferrite matrix and martensite islands distributed homogeneously on the ferrite matrix, and the banded structure is minute.

An ordinary skilled person in the art would recognize that the above examples are only intended to illustrate the invention without limiting the invention in any way, and all changes and modifications to the above examples will fall in the scope of the claims of the invention so long as they are within the scope of the substantive spirit of the invention.

The invention claimed is:

1. An at least 780 MPa grade cold-rolled dual-phase strip steel, wherein the strip steel has a microstructure of equiaxed ferrite matrix and martensite islands distributed homogeneously on the ferrite matrix, and consists of the following chemical elements in mass percentage:

C 0.06~0.09%;

Si 0.15~0.28%;

Mn 1.9~2.2%;

Cr 0.1~0.4%;

Mo not added when Cr≥0.3%; and Mo=0.3%—Cr when Cr≤0.3%;

Al 0.015~0.05%;

Nb: 0.01~0.025%, Ti: 0.01-0.025%;

the balance amounts of Fe and other unavoidable impurities, wherein the cold-rolled dual-phase strip steel is manufactured by a method comprising the following steps:

1) smelting;

2) casting in which a secondary water-cooling process is used wherein a water jet capacity is not less than 0.7 L water/kg steel blank;

3) hot rolling in which an end rolling temperature is controlled to be 820~900° C., followed by rapid cooling after rolling;

4) coiling in which a coiling temperature is controlled to be 450~650° C.;

5) cold rolling; and 6) continuous annealing in which the steel is held at between 800~860° C., cooled to 640~700° C. at a cooling speed of not less than 5° C./s, further cooled to 220~280° C. at a cooling speed of between 40° C. and 100° C./s, and tempered at between 220~280° C. for 100~300 s.

2. The 780 MPa grade cold-rolled dual-phase strip steel of claim 1, wherein C 0.07~0.09% and Al 0.02~0.04%.

3. A method for manufacturing the 780 MPa grade cold-rolled dual-phase strip steel of claim 1, comprising the following steps:

1) smelting;

2) casting: a secondary water-cooling process is used wherein the water jet capacity is not less than 0.7 L water/kg steel blank;

3) hot rolling: the end rolling temperature is controlled to be 820~900° C., followed by rapid cooling after rolling;

4) coiling: the coiling temperature is controlled to be 450~650° C.;

5) cold rolling;

6) continuous annealing: holding at 800~860° C., cooling to 640~700° C. at a cooling speed of not less than 5° C./s, further cooling to 220~280° C. at a cooling speed of 40~100° C./s, and tempering at 220~280° C. for 100~300 s.

4. The method of claim 3 for manufacturing the 780 MPa grade cold-rolled dual-phase strip steel, further comprising step 7): temper rolling.

5. The method of claim 4 for manufacturing the 780 MPa grade cold-rolled dual-phase strip steel, wherein the cold rolling reduction rate is 40~60% in step 5).

6. The method of claim 4 for manufacturing the 780 MPa grade cold-rolled dual-phase strip steel, wherein the temper rolling elongation is 0.1~0.4% in step 7).

* * * * *